US005249596A

United States Patent [19]

Hickenlooper, III et al.

[11] Patent Number: 5,249,596

[45] Date of Patent: Oct. 5, 1993

[54] RESIDENTIAL HEATING AND AIR CONDITIONING BAROMETRIC BYPASS DAMPER

[75] Inventors: Harrison T. Hickenlooper, III, Palatka; Ivy G. Moses, Jacksonville, both of Fla.

[73] Assignee: Carrier Corporation, Syracuse, N.Y.

[21] Appl. No.: 846,847

[22] Filed: Mar. 6, 1992

[51] Int. Cl.[5] ..... F16K 15/03

[52] U.S. Cl. ..... 137/334; 137/527; 137/569; 236/1 B; 454/233

[58] Field of Search ..... 137/334, 338, 521, 524, 137/527, 569; 236/1 B, 49.1; 165/22; 454/229, 232, 233, 236

[56] References Cited

U.S. PATENT DOCUMENTS

| | | | |
|---|---|---|---|
| 2,465,162 | 3/1949 | Lockwood | 454/229 |
| 3,143,137 | 8/1964 | Muller | 137/524 X |
| 3,276,480 | 10/1966 | Kennedy | 137/521 X |
| 3,817,452 | 1/1973 | Dean | 251/61 |
| 3,847,210 | 11/1974 | Wells | 251/298 |
| 4,088,150 | 5/1978 | Serratto | 137/527 X |
| 4,487,363 | 12/1984 | Parker et al. | 165/22 X |
| 4,534,538 | 8/1985 | Buckley et al. | 137/527 X |
| 4,732,318 | 3/1988 | Osheroff | 165/22 X |
| 4,829,447 | 5/1989 | Parker et al. | 236/1 B |
| 4,841,733 | 6/1989 | Dussault et al. | 236/49.1 X |

FOREIGN PATENT DOCUMENTS

| | | | |
|---|---|---|---|
| 2088529 | 6/1982 | United Kingdom | 137/527 |

*Primary Examiner*—Stephen M. Hepperle

[57] ABSTRACT

A bypass damper for a forced air system comprising a freely pivotable damper blade with bent portions at the ends thereof and having an adjustment mechanism for adjusting the pressure set point of the damper.

10 Claims, 3 Drawing Sheets

RESIDENTIAL HEATING AND AIR CONDITIONING BAROMETRIC BYPASS DAMPER

BACKGROUND OF THE INVENTION

1. Field of the Invention

The present invention relates generally to a duct type single air conditioning system for a multi-zone space, and more particularly, to a barometric bypass damper and a method of adjusting the damper for regulating the air flow and pressure in a variable air quantity control system capable of regulating temperature in each zone independently of each other.

2. Description of the Prior Art

Conventional residential single air conditioning systems (which can provide both heating and cooling i.e. HVAC system) are typically controlled by a single thermostat which controls the unit with the system having fixed diffusers for supplying air to the space. Accordingly, the one set point in the thermostat will cause the temperature in the vicinity of the thermostat to be controlled to the desired level, but in other parts of the residence the temperature can vary widely due to heat load through windows, shading of spaces, heat generated by people or equipment, and various other factors. Thus, certain places in homes require more or less temperature control than others. Upstairs areas have drastically different heating/cooling requirements than downstairs areas or basements. Bedroom areas need temperature control only at certain times of the day or night. Homes with large areas of glass present several problems for maintaining a comfortable temperature. Most residences have areas that are exposed to direct sunlight during certain hours. In both Summer and Winter, those zones require different levels of heating or cooling than other part zones of the home. With a single centrally-located thermostat it is impossible to have optimum temperatures in all zones/rooms at all times.

In a zoned residence, however, individual zones with differing heating/cooling properties and hours of use can be kept at optimum temperatures. One zoning method uses separate heating and cooling units with fixed diffusers to maintain different comfort levels in different parts of the residence. However, each separate system uses its own thermostat which is centrally located in a zone to be maintained by the respective system, but, because the separate units do not function as a whole system, they may over lap in heating and cooling some areas and perform as two independent systems.

To overcome the added installation costs, added expense to operate, and the overlap problems with dual equipment zoned systems, the use of single heating and cooling units with a plurality of motorized dampers can be provided. A single unit zoned system allows different parts of a residence to be controlled at different temperatures at different times by programming a thermostat for controlling dampers in each zone for a desired temperature over a period of time. Although the zoned single HVAC system offers cost savings, greater comfort, and greater flexibility by allowing the homeowner to set different temperatures throughout the house only during times of need or occupancy, these single heating and cooling units with multiple motorized dampers also have some disadvantages. Conventional single heating and cooling zoned systems use a zone control damper system, whereby when the zone control dampers are modulating to a closed position static air pressure builds up or increases in the ducts as the individual dampers modulate closed, thereby increasing the pressure or the air supplied through the ducts to various dampers which remain open.

Prior attempts have been made to resolve the aforementioned problem of static air build-up, as by inserting a bypass damper between the air supply outlet of the HVAC unit and the return air intake of such a unit to cause a recirculation of a quantity of air or an approximation thereof which may have been closed off by zone dampers or the like and to approximate a more uniform air supply pressure to the various zones. In most of the prior art systems, the bypass damper has been controlled by an air pressure sensor or a velocity sensor associated with the air supply outlet of the HVAC unit. Such prior art systems have many shortcomings among which are that the prior art dampers did not function well and sometimes may be closed when they should have been open and the difficulty if not impossibility of locating the prior art sensors within the air supply outlet of the HVAC unit or other location in the main duct system to achieve the predetermined and consistent results desired. Further, the prior art diffuses become noisy when closed and there is no means to adjust the bypass damper to reduce the setpoint pressure to allow more air to be bypassed to eliminate the noisy diffusers.

The bypass control system in accord with this invention alleviates the aforementioned problems in the prior art systems, by providing an improved barometric bypass damper assembly independent of flow, that is a mechanical device which requires no electrical wiring or power and has a curvilinear torque/pressure (position) relation suitable to the simple mechanical controls, while having an adjustment means, independent of gravity, which allows field adjustment of the torque/-pressure relation.

SUMMARY OF THE INVENTION

Therefore, it is an object of the present invention to provide an improved barometric bypass damper for an HVAC system having automatically operated or controlled damper blades which have a generally curvilinear torque/pressure relation to control the operating pressure in the supply air system.

It is another object of the present invention to provide an improved barometric bypass damper which has a setpoint that can be adjusted in the field and is independent of the orientation in the duct system.

It is a further object of the present invention to provide an improved bypass damper for a HVAC system which may be manufactured and installed at very low cost and which requires no electrical wiring or power.

These and other objects of the present objective are attained by mechanical damper means for bypassing air from the supply to the return of a forced air HVAC system. The damper includes a generally plain rectangular damper blade having bend portions at each end and rotatable about an axis transverse to the duct, but offset from the centerline of the duct thus introducing turbulence into the air flow at the edges of the blade which increases the force on the blade to cause a curvilinear torque/pressure relation when opening and closing the damper. The damper further includes a spring force means which acts against the air flow through the damper in the closing direction. The spring force means has an adjustment mechanism for changing the operating pressure of the damper while installed in the forced air system.

BRIEF DESCRIPTION OF THE DRAWINGS

Still other objects and advantages of the present invention will be apparent from the following detailed description in conjunction with the accompanying drawings in which reference numerals designate like or corresponding parts throughout the same, in which.

DESCRIPTION OF THE PREFERRED EMBODIMENT

Figure 1:
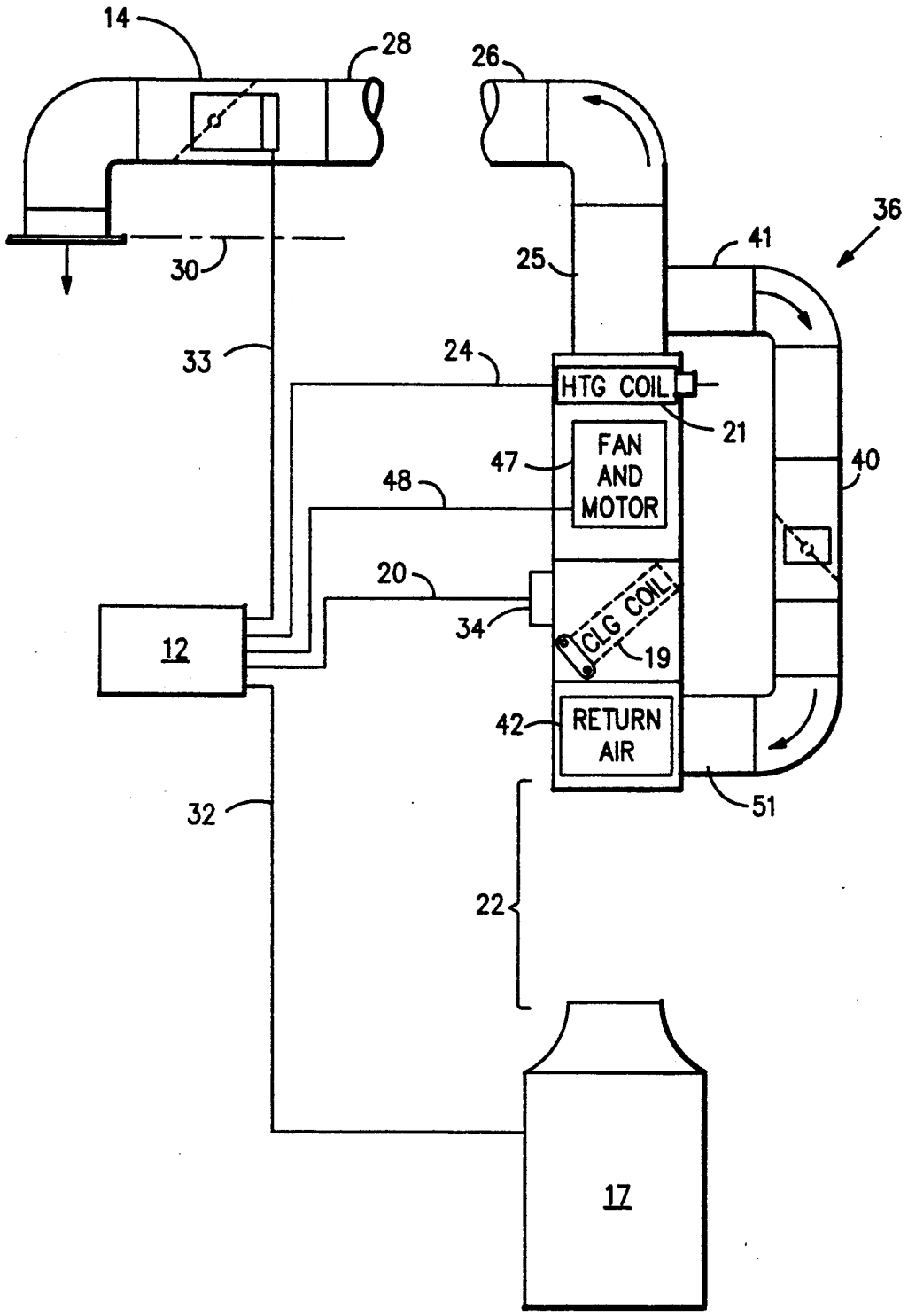
FIG. 1 is a schematic illustration of a residential zone duct type air conditioning system and a barometric bypass damper therefore according to the principles of the present invention.

Referring to FIG. 1, the thermostat 12 has an electrical connection 33 to zone damper assembly 14. It is to be understood that thermostat 12 and damper 14 are representative and usually a plurality of master and slave zone thermostats 12 and zone dampers 14 are provided in or associated with each room or zone 30. The damper 14 is located in a branch air duct 28 which communicates between zone 30 and the main air supply duct 26 connected to the outlet 25 of the HVAC unit 22. The thermostat 12 includes an electrical connection 24 to the heating coil 21 of the HVAC unit 22. A monitor sensor probe 34 associated with the cooling coil 19 of the HVAC unit 22 is coupled to thermostat 14 via electrical connection 20. The monitor sensor probe 34 is shown in position to sense the refrigeration circuit only without sensing the resistance heater 21 in a heat pump installation. In other installations the monitor sensor probe 34 is located where it will sense the temperature of both the heating and cooling circuits. Also, thermostat 12 is provided with an electrical connection 32 to condensing unit 17 of HVAC unit 22.

The bypass system 36 in accordance with this invention includes a bypass damper 40 communicating with the air outlet 25 from the HVAC unit 22 by branch duct 41 and communicating with the air return 42 of the HVAC unit 22 by branch duct 51. The size of the bypass damper 40 together with the size of branch ducts 41 and 51 depend on many variables known to a person skilled in the air, but typically the sizes include 8, 10, 12, 14 and 24 inches. The thermostat 12 is provided with an electrical connection 48 to fan motor 47.

The bypass system utilizes a pressure setpoint adjustment mechanism to change the position of a bypass damper 40 in a bypass duct between the air outlet and return air intake of a HVAC unit 22. Such a bypass system is effective to inhibit the HVAC duct system from excessive static air pressures. When the dampers 14 are used to control multiple zones 30 of a single zone HVAC unit; excessive stat air pressure in the duct system will occur as the zone dampers modulate closed. To compensate for excessive static air pressure from occurring, the bypass control system 36, herein disclosed will alleviate such problem.

The bypass system 36 is to be used on HVAC unit 22 which is equipped with a forced air blower and motor 47. As the zone control dampers 14 modulate closed, the amount of air which the HVAC blower is moving will drop due to the increased static air resistance in the duct system. As the blower does less work, the bypass damper 40 opens until the fan output returns to its original setting. Thus, a predetermined amount of supply air from the HVAC unit 22, is bypassed through bypass damper 40 to the HVAC return air intake without passing into the main air supply duct 26.

As the zone control dampers 14 modulate closed, an increase in the main air supply duct 26 air pressure will result. Consequently, the bypass damper pressure setting should be selected as high as possible to bypass the quantity of air which is being closed off by the dampers 14 and to maintain the flow of as much air as possible into the zones 30 rather than allowing the air to flow through the bypass damper. The damper blade configuration introduces turbulence into the air flow which results in a generally curvilinear torque/blade position relation to control movement of such blade.

A good bypass system design dictates that the bypass damper 40 will be selected to increase the static air pressure to 0.4" WC 1.20" WC, and preferably 0.75" WC.

Figure 2:
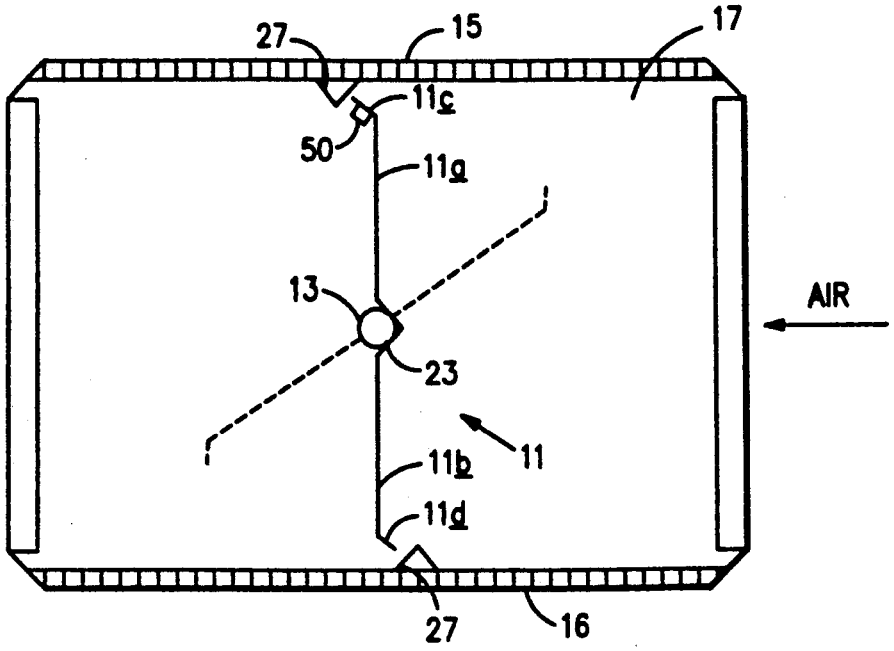
FIG. 2 shows the interior of the barometric bypass damper having a rotatable damper blade according to the principles of the present invention mounted therein.
Figure 3:
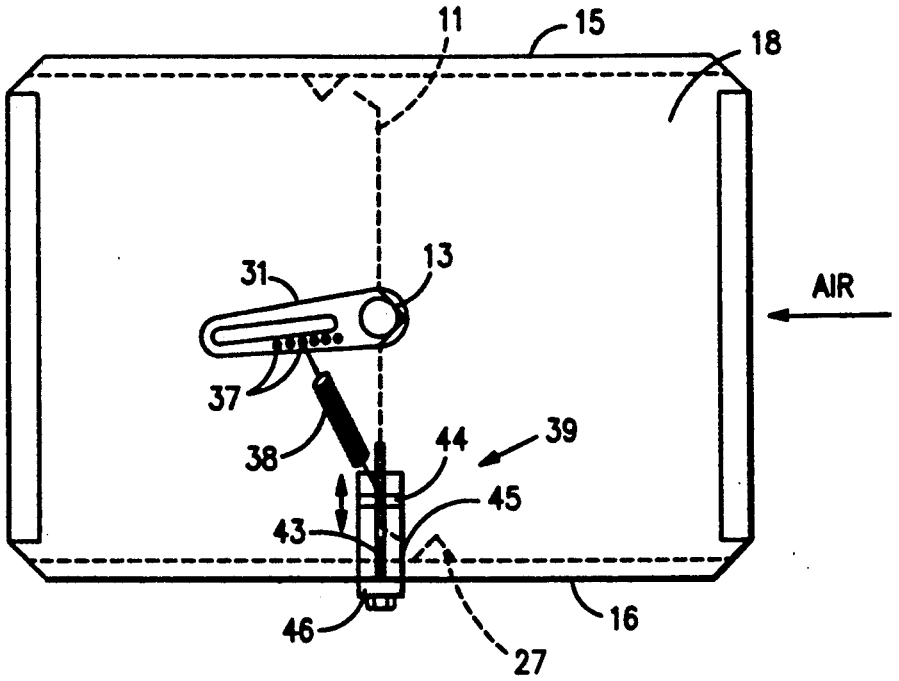
FIG. 3 shows the exterior of the side of the barometric bypass damper with a pressure setpoint adjustment mechanism according to the principles of the present invention.
Figure 4:
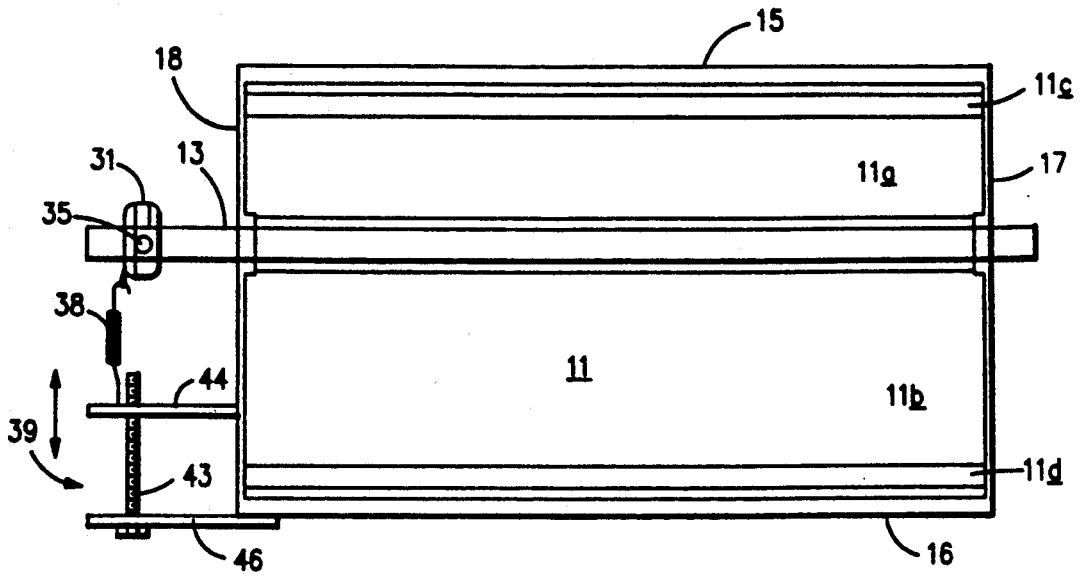
FIG. 4 shows the interior of the upstream end of the barometric bypass damper according to the principles of the present invention.

Referring now to FIGS. 2, 3 and 4, the bypass damper 40 is a rectangular section, generally fabricated of sheet metal, having top and bottom walls 15, 16 with side walls 17, 18 having a shaft 13 mounted and journaled there between with air entering at the end in the direction of the arrow. A damper blade 11 is secured to the shaft 13 by means of a v-shaped portion 23 by a suitable means, such as tack welding, and pivots across the opening formed by the walls. The shaft 13 is placed unsymmetrically between the top and bottom walls 15, 16 thereby forming a first smaller upper blade portion 11*a* and a second larger lower blade portion 11*b*. The smaller blade portion 11*a* is provided with a bent blade member 11*c* along its edge, and the larger blade portion 11*b* is provided with a bent blade member 11*d* along its edge. The bent member 11*c* is offset generally at an angle of 45° from the vertical in the direction of air flow, while the bent member 11*d* is offset generally at an angle of 45° away from the direction of air flow. The bent blade members 11*c*, 11*d* introduce turbulence or recirculation into the air flow which causes flow losses in the air stream resulting in a curvilinear torque/pressure relation to assist in the control of the damper blade. The bent blade members 11*c*, 11*d* also provide rigidity to the damper blade 11. The damper blade abuts against stop means 27 in the fully closed position to prevent the damper blade 11 from rotating in the wrong direction. For a nominal 8 inch high bypass damper the damper blade 11 would be 7.4 inches high, with the smaller blade portion being 2.9 inches and the larger blade portion being 4.5 inches, thus this upper and lower blade portions have unequal surface areas. Accordingly, these area ratios position the shaft about four-tenths of the distance between the top and bottom wall 15, 16 which provides the damper with a 10°-15° deadband of operation prior to a significant open area appearing. Further, these ratios allow the damper to be positioned in the duct in any orientation, provided a counter weight 50 is secured to the smaller blade protion 1a to equalize the mass of the blade portions about the shaft 13.

As clearly shown in FIG. 3, one end of shaft 13 is disposed outside side wall 18, and lever arm 31 is adjustably attached to the shaft 13 by set screw 35. The lever arm 31 having plurality of spaced apertures 37 along its length, projects radially from the shaft 13. The spaced apertures 37 are used as attachment points for a tension spring 38. Adjacent the lever arm 31, and along the axis of the closed damper blade 11, is an adjustment means 39 including an adjustment screw 43, a slidable nut 44 slidable in channel 45 in the direction of the arrow, and a fixed support 46 to allow rotation of the adjustment screw with respect thereto without allowing axial movement of the adjustment screw. One end of the tension spring 38 is hooked into one of the spaced apertures 37 while the opposite end is connected to slidable nut 44.

The adjustment means 39 provides a pressure setpoint for the damper 40. This pressure setpoint is the difference between the inlet and discharge bypass duct pressures. This pressure setpoint should be as high as possible to allow as much air as possible to go into the comfort zones or spaces rather than through the bypass damper. The pressure setting will generally be fixed by the noise in the forced air duct system. If the outlet diffusers in the comfort zones are noisy, then the pressure setting may be reduced until a satisfactory setting is achieved.

Figure 5:
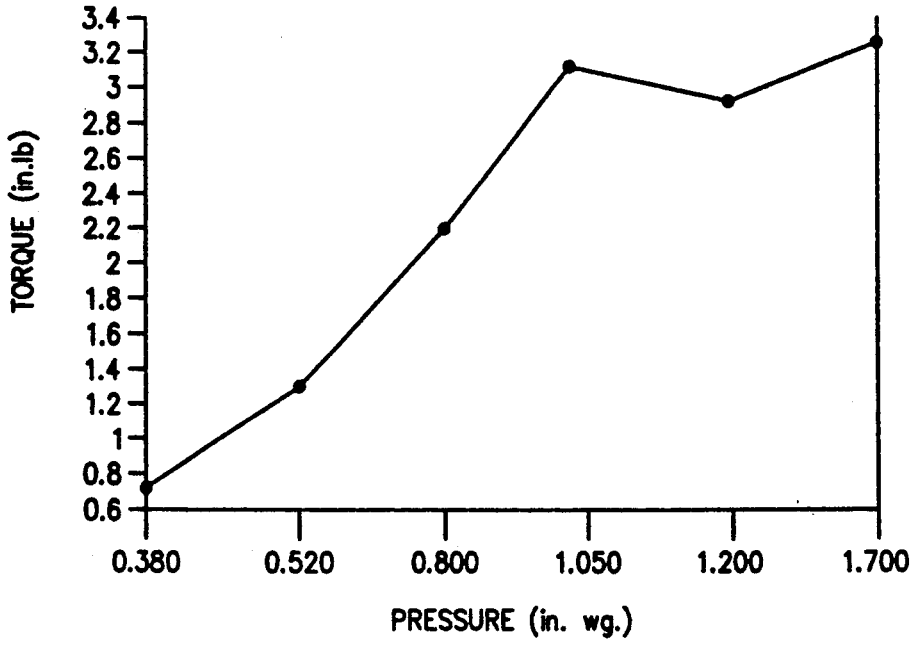
FIG. 5 shows the torque/pressure relation of a bypass damper according to the principles of the present invention.

FIG. 5 shows a diagram of the torque (in.lb) versus pressure (in.WG) for a bypass damper at 45 degrees from fully closed.

In operation, large changes in the pressure setting can be made by changing the tension spring 38 connection on the lever arm 31 by hooking the spring in a desired aperture 37. The apertures further from the shaft 13 are for higher pressures. Each aperture 37 will change the pressure setpoint approximately 0.25 in. WG, starting at about 0.40 in.WG at the aperture closest to the shaft 13. Smaller changes in the pressure setting can be made by turning the adjustment screw 43 which in-turn moves the slidable nut 44 to change the length of the tension spring 38. To increase the pressure setpoint, turn the adjustment screw 43 clockwise, and to decrease the pressure setting turn the adjustment screw 43 in the counter-clockwise direction. From the foregoing, it can be seen that a method for adjusting the operating pressure of the bypass damper in a field situation can be accomplished with the present invention.

While the present invention has been described in detail with reference to the illustrative embodiment, many modifications and variations would present themselves skilled in the art without the parting from the true spirit and scope of the invention.

What is claimed is:

1. In a forced air system having a conditioning means to thermally condition air and a plurality of zones with modulating damper means for maintaining a desired temperature in each zone, a barometric bypass damper for bypassing conditioned air therethrough from a supply of the conditioning means to a return of the conditioning means in response to the modulation of the modulating damper means, comprising:

a duct having two pairs of opposed walls defining an air flow path between an upstream supply line and a downstream return line of said conditioning means;

a damper blade mounted on a shaft transversely between a first pair of said opposed walls for rotational movement about an axis coincident with said shaft, whereby said shaft is located away from the middle distance between a second pair of said opposed walls wherein said damper blade includes first and second portions of unequal surface areas that extend in opposite directions from said shaft; and first and second end portions connected to and obtusely angled from an edge of said first and second portions of said damper blade wherein said first end portion is connected to said unequal surface area of smaller area and is angled toward the downstream return line and said second end portion is connected to said unequal surface area of larger area and is angled toward the upstream supply line.

2. A bypass damper as setforth in claim 1 wherein said first and second end portions are angled at forty-five degrees from a plane of said first and second portions of unequal surface areas.

3. A bypass damper as setforth in claim 2 wherein said axis of said shaft is generally located four-tenths the distance between said second pair of opposed walls.

4. A bypass damper as setforth in claim 3 wherein said unequal surface area of smaller area has a weight means attached thereto whereby the mass of said first and second portions of said damper blade are generally equal.

5. A pressure setpoint adjustment apparatus for an air damper comprising:

a duct having two pairs of opposed walls defining an air flow path between upstream and downstream open ends;

a damper blade mounted on a shaft transversely between a first pair of said opposed walls for rotational movement about an axis coincident with said shaft, said shaft extending through one of said first pair of said opposed walls and being offset a predetermined distance from the middle distance between a second pair of opposed walls;

a lever arm secured to a shaft portion extending through said opposed walls and extending radially from said shaft portion, said lever air having a plurality of apertures along the radial length thereof;

adjusting means having a fixed support member having a rotatable screw connected thereto, said rotatable screw secured from movement along the longitudinal axis thereof and having a slidable nut means slidable along the longitudinal axis of said rotatable screw and fixed from rotation about said rotatable screw; and a biasing means movably supported at one end in one of said plurality of apertures in said lever arm and fixedly supported at the other end to said slidable nut means to adjust the pressure setpoint at which said damper blade rotates about said shaft, said biasing means being at an acute angle with respect to the longitudinal axis of said rotatable screw.

6. A pressure setpoint adjustment apparatus as setforth in claim 5 wherein said biasing means is a tension spring.

7. A pressure setpoint adjustment apparatus as setforth in claim 6 wherein said slidable nut means slides in a channel means which prevents rotational movement of said slidable nut means.

8. A pressure setpoint adjustment apparatus as set forth in claim 5 wherein the longitudinal axis of said rotatable screw lies along the plane of said damper blade when in a closed position within said duct.

9. A pressure setpoint adjustment apparatus as set-forth in claim 5 wherein said damper blade includes first and second portions of unequal damper surface areas that extend in opposite directions from said shaft.

10. A pressure setpoint adjustment apparatus as set-forth in claim 9 further comprising:

first and second end portions connected respectively to and obtusely angled from said first and second portions of said damper blade.

* * * * *